US005848556A

United States Patent [19]

Ryu et al.

[11] Patent Number: 5,848,556

[45] Date of Patent: Dec. 15, 1998

[54] ROBOT HAVING DUST MINIMIZING CABLE ARRANGEMENT

[75] Inventors: Ji-seok Ryu, Suwon; Yong-soo Shin, Kunpo, both of Rep. of Korea

[73] Assignee: Samsung Electronics Co., Ltd., Rep. of Korea

[21] Appl. No.: 805,627

[22] Filed: Feb. 26, 1997

[51] Int. Cl.[6] ..... G05G 11/00

[52] U.S. Cl. ..... 74/490.02; 74/490.03; 174/151; 248/65; 901/23

[58] Field of Search ..... 74/490.02, 490.03; 901/23, 49; 248/65, 145; 174/168, 170

[56] References Cited

U.S. PATENT DOCUMENTS

| | | | |
|---|---|---|---|
| 3,719,770 | 3/1973 | Richardson, Jr. | 248/65 |
| 4,107,456 | 8/1978 | Schuster et al. | 174/151 |
| 4,465,253 | 8/1984 | Lang et al. | 248/65 |
| 4,754,663 | 7/1988 | Yasukawa | 901/23 |
| 4,864,888 | 9/1989 | Iwata | 74/490.02 |
| 5,000,653 | 3/1991 | Gosdowski | 901/23 |

*Primary Examiner*—Charles A. Marmor
*Assistant Examiner*—David Fenstermacher
*Attorney, Agent, or Firm*—Burns, Doane, Swecker & Mathis LLP

[57] ABSTRACT

A robot includes: a base; a column installed to the base; a first arm of which one end is rotatably coupled to the column and having at least one through hole; a second arm pivotally coupled to the other end of the first arm and having at least one through hole; a third arm installed to be capable of rotating and moving up and down with respect to the second arm; first and second driving portion, installed at the first arm, for driving the first arm and the second arm, respectively; third driving portion, installed at the second arm, for driving the third arm; and a cable extended through a cavity formed inside the base, the column, the first, second and third arms and connected to the first, second, and third driving portion through the respective holes formed in the first and second arms. Thus, generation of dust due to friction between the cable and the robot can be prevented.

5 Claims, 3 Drawing Sheets

ROBOT HAVING DUST MINIMIZING CABLE ARRANGEMENT

BACKGROUND OF THE INVENTION

The present invention relates to a robot, and more particularly, to a robot having a cable installed inside the body thereof to restrict the generation of dust.

In general, since robots are used in various industrial fields, they should be manufactured to satisfy many requirements for an individual work place. Particularly, in the field of electronics, a parts mounting robot is usually used to mount electronic parts on a printed circuit board. In such fields, the performance of the electronic goods can be effected by the dust generated at the manufacturing line. Also, in the case of a robot used for semiconductor manufacturing, the work place should be clean since fine dust can render the semiconductor devices inferior. Accordingly, many solutions have been suggested in order to remove the causes of dust generation during the operation of the robot.

FIG. 1 schematically shows a robot according to conventional technology. Referring to the drawing, a robot 10 includes a column 12 fixed to a base 11 and first through third arms 13, 14 and 15. The first arm 13 pivots around the column 12 driven by a first motor 16 which is fixed to the upper surface of the first arm 13, and also, moves up and down along the column 12 with respect to the base 11 by an additional driving means (not shown). The second arm 14 is pivotally coupled to an end portion of the first arm 13, and pivots with respect to the first arm 13 by means of a second motor 17 which is installed on the upper surface of the first arm 13. The third arm 15 installed at an end portion of the second arm 14 is rotatable by the driving of a third motor 18, and also, is moved up and down by an additional driving means (not shown).

An operational unit 25 is installed at an end portion of the third arm 15, which is formed according to the functions of the robot. For instance, the operational unit 25 can be a nozzle which sucks up a semiconductor chip, or a hand which picks up a component. Also, the robot 10 further includes an air cylinder (not shown) or an electrical motor (not shown) which operates the operational unit 25.

In the robot having such a structure, a cable 19 which provides power to the respective motors 16, 17 and 18 and the respective arms 13, 14 and 15 and controls the movements of the arms 13, 14 and 15, are exposed. That is, the cable 19 drawn from a hole 20 formed in the base 11 is connected to the first motor 16 and the second motor 17 via holes 21 and 22 formed in the upper portion of the first arm 17. Then, the cable 19 is connected to the third motor 18.

When the robot 10 operates, the cable 19 is moved as the first arm 13 pivots with respect to the base 11. At this time, due to the relative pivotal movements of the arms 13–15, the cable 19 is twisted. Also, when the cable 19 is moved, the cable 19 rubs against the arms 13–15, or the friction between the friction between the cable 19 and the holes 20–22 is generated. Such rubbing and friction generate dust, which does not satisfy the requirements for a clean room environment.

SUMMARY OF THE INVENTION

To solve the above problems, it is an object of the present invention to provide a robot which prevents twisting of a cable and generation of dust due to rubbing of the cable so that a clean room environment place is possible.

Accordingly, to achieve the above object, there is provided a robot includes: a base; a column installed to the base; a first arm of which one end is rotatably coupled to the column and having at least one through hole; a second arm pivotally coupled to the other end of the first arm and having at least one through hole; a third arm installed to be capable of rotating and moving up and down with respect to the second arm; first and second driving portion, installed at the first arm, for driving the first arm and the second arm, respectively; third driving portion, installed at the second arm, for driving the third arm; and a cable extended through a cavity formed inside the base, the column, the first, second and third arms and connected to the first, second, and third driving portion through the respective holes formed in the first and second arms.

It is also preferred that the robot further includes a cable supporting portion which is installed on top of the column in the cavity of the first arm.

It is further preferred that the cable supporting portion includes: a bracket having a circular upper plate, a circular lower plate having a through hole for passing the cable, and a vertical portion connecting thee upper plate and the lower plate, which are integrally formed; a shaft fixed to the upper plate of the bracket; a holder rotatably retained by the shaft; and a ring attached to the holder and through which the cable passes.

It is yet further preferred that the center of the shaft is a predetermined distance off-center and does not correspond to the center of the thorough hole formed in the lower plate of the bracket.

It is still further preferred that a sealing member is provided to prevent escape of dust at the though hole formed in the first and second arms through which the cable passes.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
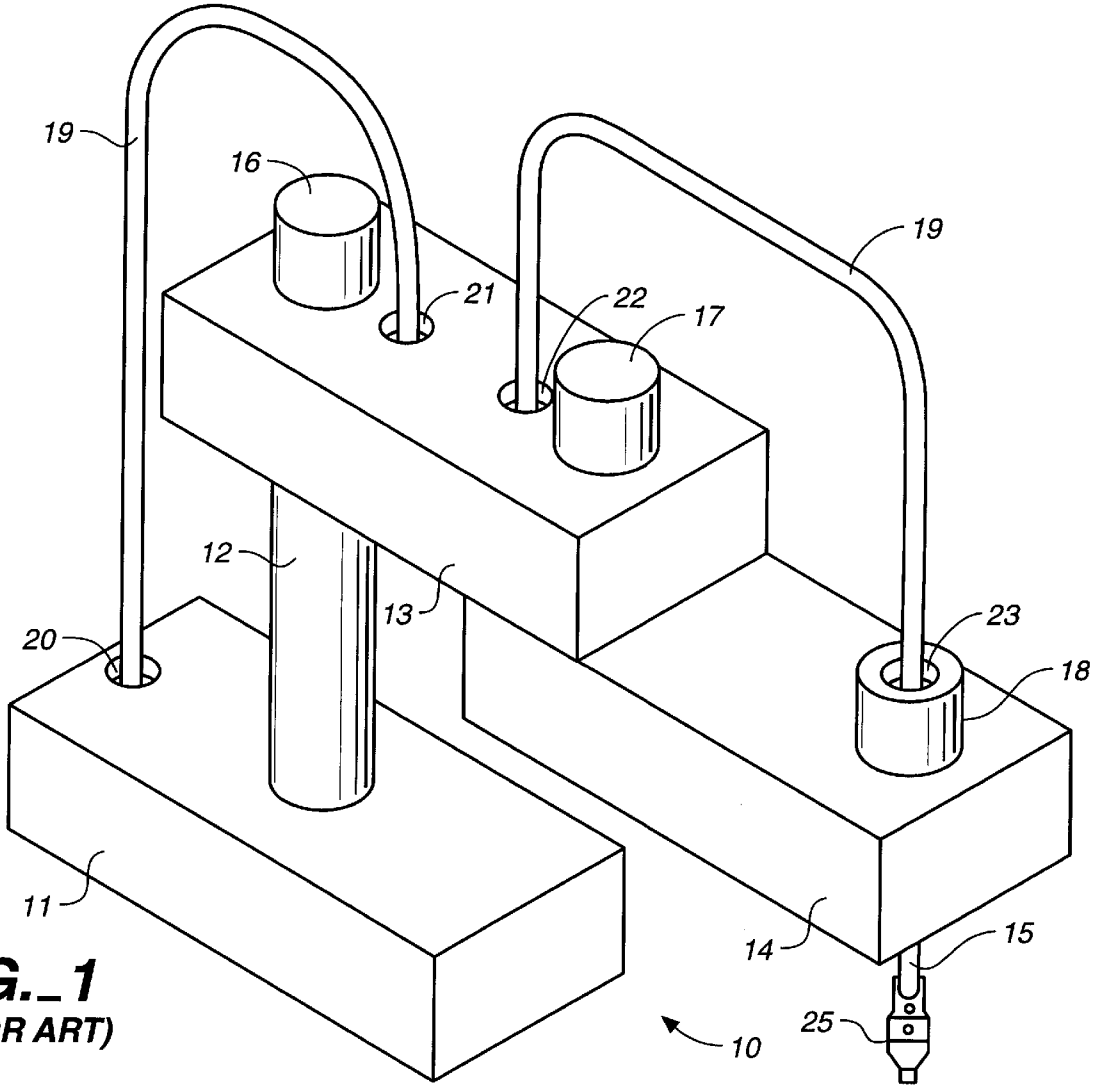
FIG. 1 (PRIOR ART)
FIG. 1 is a perspective view illustrating a robot according to conventional technology.
Figure 2:
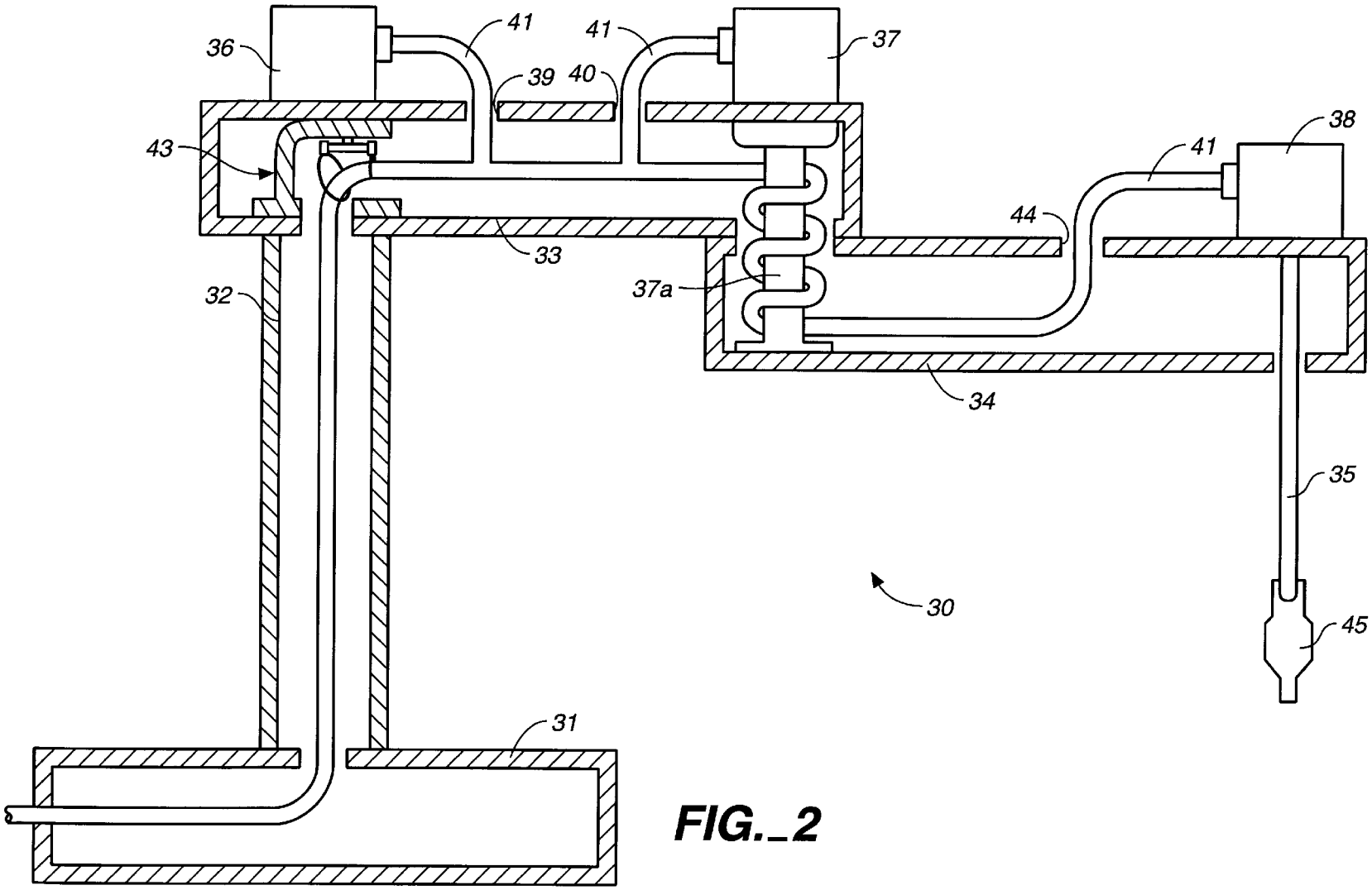
FIG. 2 is a schematic sectional view of a robot according to the present invention.

Referring to FIG. 2, the robot 30 according to the present invention includes a column 32 fixed to the upper portion of the base 31, a first arm 33 of which one end is rotatably coupled to the column 32, a second arm 34 pivotally coupled to the other end of the first arm 33, and a third arm rotatably coupled to an end portion of the second arm 34. Also, the first and third arms 33 and 35 are respectively moved up and down by an additional driving means (not shown). Preferably, an operational unit 45 such as a nozzle or a hand is installed at an end portion of the third arm 35. The first motor 36 and the second motor 37 are fixed on top of the first arm 33 and the third motor 38 is fixed to the upper surface of the second arm 34.

The present invention is characterized in that a cable 41 for supplying power to the robot or controlling the robot is provided through a cavity formed inside the base 31, the column 32 and the arms 33 and 34. The cable 41 drawn from the outside into the inside of the base 31 is extended vertically through the cavity of the column 32 and horizontally through the cavity of the first arm 33. A supporting means 43 is provided at a portion where the cable 41 is bent at a right angle.

The cable 41 extends to the first and second motors 36 and 37 passing through the holes 39 and 40 formed in the upper portion of the first arm 33. Thus, when the first arm 33 rotates, friction is not generated between the cable 41 and the holes 39 and 40.

The cable 41 extended through the inside of the first arm 33 is wound around a shaft 37*a* and extends to the inside of the second arm 34. Then, the cable 41 is drawn out through the hole 44 formed in the upper portion of the second arm 34 and connected to the third motor 38. Thus, when the second arm 34 rotates, no friction is generated between the cable 41 and the hole 44. Gaps between the cable 41 and the holes 39, 40 and 44 are preferably sealed by a sealing member to prevent dust escaping from the inside of the robot.

Figure 3A:
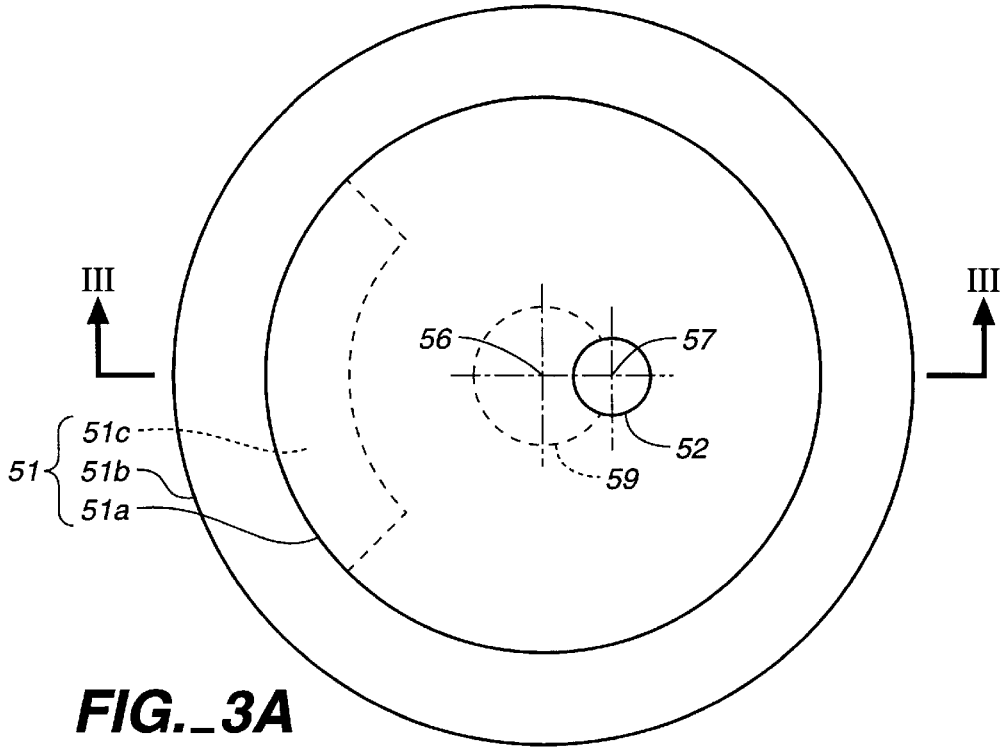
FIGS. 3A and 3B are a plan view and a sectional view each showing the cable supporting means shown in FIG. 2.
Figure 3B:
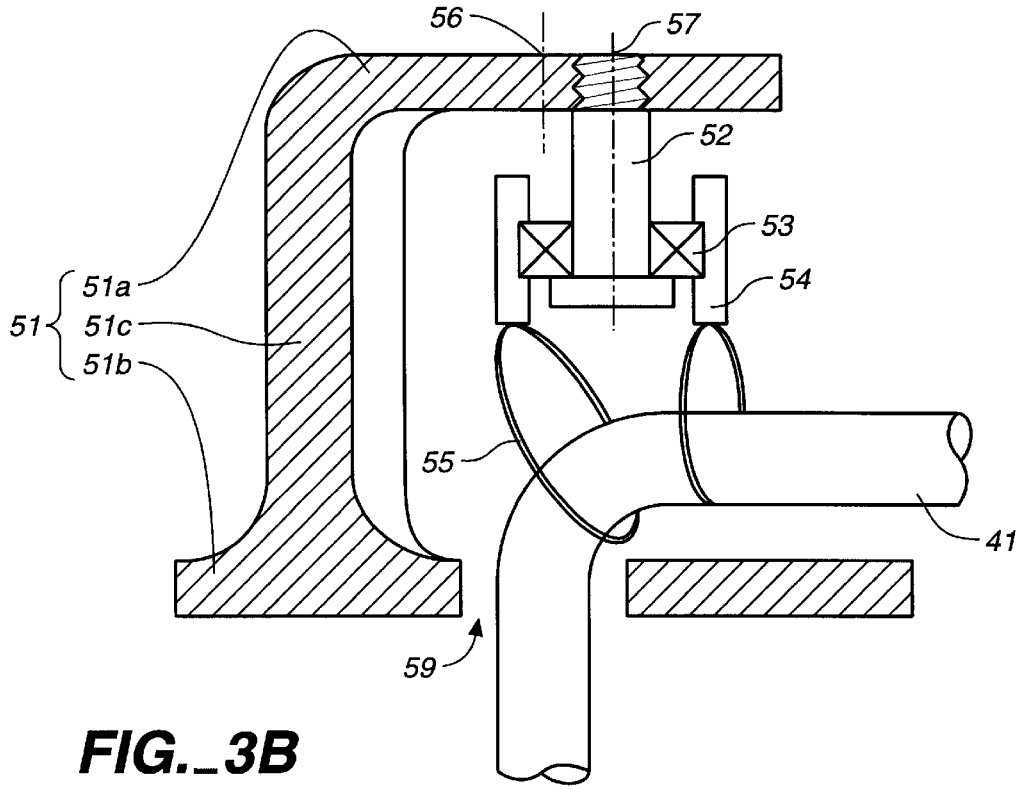

FIG. 3A shows the cable supporting means 43 shown in FIG. 2, and FIG. 3B is a sectional view taken along line III—III of FIG. 3A. Referring to FIGS. 3A and 3B, the cable supporting means includes a bracket 51, a shaft 52 fixed to the bracket 51, and a holder 54 coupled to the shaft 52 and having cable supporting rings 55. The bracket 51 includes a circular upper plate 51*a*, a circular lower plate 51*b* provided on top of the column 32, and a vertical portion 51*c* connecting the upper and lower plates 51*a* and 51*b*. The holder 54 is rotatable around the shaft 52 by means of a bearing 53. The cable supporting ring 55 supports the portion of the cable 41 which extends from the column 32 to the first arm 33. When the first arm 33 is rotated, the holder 54 rotates a predetermined number of degrees due to the cable 41 hanging on the cable supporting ring 55.

As shown in FIGS. 3A and 3B, the center 57 of the shaft 52 fixed to the bracket 51 is a predetermined distance off-center from the center 56 of a through hole 59 through which the cable 41 passes. Such eccentricity of the center 57 of the shaft 52 can minimize twisting stresses applied to the cable 41 by increasing the radius of curvature of an arc formed when the cable 41 extends from a vertical state to a horizontal state. That is, the concentration of stress to a particular portion of the cable 41 can be prevented, and when the cable 41 receives bending stress during the rotation of the first arm 33, the stress can be uniformly distributed throughout the entire bent length of the cable 41. Also, since the cable 41 is supported by the ring 55 of the holder 54 and the holder 54 is rotatable, friction between the cable 41 and the through hole 59 formed in the lower plate 51*b* of the bracket 51 can be minimized and further twisting of the cable 41 can be prevented.

As described above, in the robot according to the present invention, since the cable for transmitting power to the robot and controlling the same is extended through the cavity inside each component of the robot, the friction between the cable and the hole through which the cable passes can be prevented to thereby decrease the amount of dust generated. Also, disconnection and destruction of the cable according to the repetitive operation of the robot can be prevented by providing the cable supporting means which guides the movement of the cable according to the operation of the robot.

What is claimed is:

1. A robot comprising:

a base;

a column installed to said base;

a first arm of which one end is rotatably coupled to said column and having at least one through hole;

a second arm pivotally coupled to the other end of said first arm and having at least one through hole;

a third arm installed to be capable of rotating with respect to said second arm;

first and second driving means, installed at said first arm, for driving said first arm and said second arm, respectively;

third driving means, installed at said second arm, for driving said third arm; and a cable extended through a cavity formed inside said base, said column, and said first arm, the cable being connected to said first and second driving means through said at least one through hole formed in said first arm, and extending through a cavity formed inside said second arm for connection to said third driving means through said at least one through hole formed in said second arm, said cable traversing said one end of the first arm and said other end of the first arm inside the cavity formed in said first arm.

2. A robot as claimed in claim 1, further comprising a cable supporting means which is installed on top of said column in the cavity of said first arm.

3. A robot as claimed in claim 1, wherein a sealing member is provided to prevent escape of dust at said at least one through hole formed in said first and second arms through which said cable passes.

4. A robot comprising:

a base:

a column installed to said base;

a first arm of which one end is rotatable coupled to said column and having at least one through hole;

a second arm pivotally coupled to the other end of said first arm and having at least one though hole;

a third arm installed to be capable of rotating with respect to said second arm;

first and second driving means installed at said first arm, for driving said first arm and said second arm, respectively;

a cable extended through a cavity formed inside said base, said column, and said first, second, and third arms and connected to said first, second, and third driving means through said respective through holes formed in said first and second arms: and a cable supporting means which is installed on top of said column in the cavity of said first arm, said cable supporting means comprising:

a bracket having a circular upper plate, a circular lower plate having a through hole for passing said cable, and a vertical portion connecting said upper plate and said lower late, which are integrally formed;

a shaft fixed to said upper plate of said bracket;

a holder rotatably retained by said shaft; and a ring attached to said holder and through which said cable passes.

5. A robot as claimed in claim 4, wherein the center of said shaft is a predetermined distance off-center and does not correspond to the center of said thorough hole formed in said lower plate of said bracket.

* * * * *